US008608307B2

(12) United States Patent
Thayer et al.

(10) Patent No.: US 8,608,307 B2
(45) Date of Patent: Dec. 17, 2013

(54) TRANSFIX ROLLER FOR USE IN AN INDIRECT PRINTER WITH AN IMAGE RECEIVING MEMBER HAVING A THIN WALL

(75) Inventors: Bruce Earl Thayer, Spencerport, NY (US); Bin Zhang, Penfield, NY (US); Palghat S. Ramesh, Pittsford, NY (US); Anthony S. Condello, Webster, NY (US); Paul J. McConville, Webster, NY (US); Trevor James Snyder, Newburg, OR (US)

(73) Assignee: Xerox Corporation, Norwalk, CT (US)

( * ) Notice: Subject to any disclaimer, the term of this patent is extended or adjusted under 35 U.S.C. 154(b) by 137 days.

(21) Appl. No.: 13/236,059

(22) Filed: Sep. 19, 2011

(65) Prior Publication Data

US 2013/0070037 A1 Mar. 21, 2013

(51) Int. Cl.
*B41J 2/01* (2006.01)
*B41J 2/175* (2006.01)

(52) U.S. Cl.
USPC ..... 347/103; 347/88

(58) Field of Classification Search
None
See application file for complete search history.

(56) References Cited

U.S. PATENT DOCUMENTS 3,521,024 A * 7/1970 Roach ..... 219/89
3,999,038 A 12/1976 Sikes, Jr. et al.
4,042,804 A 8/1977 Moser
4,594,068 A 6/1986 Bardutzky et al.
4,841,613 A 6/1989 Beery et al.
5,070,231 A 12/1991 Bacus et al.
5,195,430 A 3/1993 Rise
5,229,813 A 7/1993 Cherian
5,253,026 A 10/1993 Tamary
5,286,245 A 2/1994 Schiel
5,429,048 A * 7/1995 Gaffney et al. ..... 101/217
5,467,178 A 11/1995 Mui et al.
5,732,319 A * 3/1998 Komuro et al. ..... 399/331
5,777,650 A 7/1998 Blank
5,967,957 A 10/1999 Kusters
6,527,386 B1 3/2003 Blank et al.
6,803,932 B2 * 10/2004 Itoh et al. ..... 347/112
6,898,410 B2 5/2005 Boss
7,147,596 B2 12/2006 Reynolds
7,251,447 B2 7/2007 Kanamori et al.
7,325,917 B2 2/2008 Kohne et al.
7,407,278 B2 8/2008 Kohne et al.
7,845,783 B2 12/2010 Gervasi et al.
7,896,488 B2 3/2011 Gervasi et al.
7,931,362 B2 4/2011 Burke
2004/0252175 A1 12/2004 Bejat et al.
2007/0076080 A1 * 4/2007 Knierim et al. ..... 347/103
2007/0084366 A1 4/2007 Costanza et al.
2010/0120592 A1 5/2010 Wu
2010/0236438 A1 9/2010 Roof et al.

* cited by examiner

*Primary Examiner* — Stephen Meier
*Assistant Examiner* — Alexander C Witkowski
(74) *Attorney, Agent, or Firm* — Maginot, Moore & Beck, LLP

(57) ABSTRACT

A transfix roller is adapted for use with a thin walled image receiving member in an indirect printer. The transfix roller is centrally supported to present a more uniform pressure profile in the nip formed with the image receiving member. An interference fit between the central shaft and the roller sleeve enables the transfix roller to be made without an additional process to secure the shaft to the sleeve.

20 Claims, 7 Drawing Sheets

TRANSFIX ROLLER FOR USE IN AN INDIRECT PRINTER WITH AN IMAGE RECEIVING MEMBER HAVING A THIN WALL

TECHNICAL FIELD

The system described below relates to printers in which an image is transferred from an image receiving surface to a recording medium, and, more particularly, to printers in which the image is transferred to the recording medium as the medium passes through a nip between a transfix roller and an image receiving member.

BACKGROUND

The word "printer" as used herein encompasses any apparatus, such as a digital copier, book marking machine, facsimile machine, multi-function machine, etc., that produces an image with a colorant on recording media for any purpose. Printers that form an image on an image receiving member and then transfer the image to recording media are referenced in this document as indirect printers. Indirect printers typically use intermediate transfer, transfix, or transfuse members to facilitate the transfer of the image from the image receiving member to the recording media. In general, such printing systems typically include a colorant applicator, such as a printhead, that forms an image with colorant on the image receiving member. Recording medium is fed into a nip formed between the surface of the image receiving member and a transfix roller to enable the image to be transferred and fixed to the print medium so the image receiving member can be used for formation of another image.

A schematic diagram for a typical indirect printer that includes a printhead that ejects phase change ink on the image receiving member to form an image on the member is illustrated in FIG. 7. The solid ink imaging device, hereafter simply referred to as a printer 110, has an ink loader 112 that receives and stages solid ink sticks. The ink sticks progress through a feed channel of the loader 112 until they reach an ink melt unit 114. The ink melt unit 114 heats the portion of an ink stick impinging on the ink melt unit 114 to a temperature at which the ink stick melts. The liquefied ink is supplied to one or more print heads 116 by gravity, pump action, or both. Printer controller 122 uses the image data to be reproduced to control the print heads 116 and eject ink onto a rotating print drum or image receiving member 140 as image pixels for a printed image. Recording media 120, such as paper or other recording substrates, are fed from a sheet feeder 118 to a position where the image on the drum 140 can be transferred to the media. To facilitate the image transfer process, the media 120 are fed into a nip between the transfer, sometimes called transfix roller 150, and the rotating print drum 140. In the nip, the transfix roller 150 presses the media 120 against the print drum 140. An assembly 124 of lever arms, camshafts, cams, and gears urged into motion by an electrical motor responds to signals from the controller 122 to move the transfix roller into and out of engagement with the print drum 140. Indirect or offset printing refers to a process, such as the one just described, of generating an ink or toner image on an intermediate member and then transferring the image onto some recording media or another member.

To optimize image resolution in an indirect printer, the conditions within the nip are carefully controlled. The transferred ink drops should spread out to cover a specific area to preserve image resolution. Too little spreading leaves gaps between the ink drops while too much spreading results in intermingling of the ink drops. Additionally, the nip conditions are controlled to maximize the transfer of ink drops from the image member to the print medium without compromising the spread of the ink drops on the print medium. Moreover, the ink drops should be pressed into the paper with sufficient pressure to prevent their inadvertent removal by abrasion thereby optimizing printed image durability. Thus, the temperature and pressure conditions are carefully controlled and must be consistent over the entire area of the nip.

When an indirect printer, such as the one shown in FIG. 7, is powered on, the image receiving member needs to be heated to a predetermined temperature that enables the melted phase change ink to remain on the surface of the image receiving member, yet be malleable enough for transfer and fixing to the recording media when the ink image enters the nip. An image receiving member with a larger thermal mass requires more thermal energy and more time to reach the predetermined temperature than an image receiving member that has a smaller thermal mass. In an effort to reduce the time required for an image receiving member to reach the predetermined temperature, the wall of an image receiving member has been reduced in thickness. While this reduction in wall thickness does decrease the time required for the image receiving member to reach the predetermined temperature, it also affects the pressure conditions in the nip formed with the transfix roller.

Without a change in the transfix roller, the pressure in the nip becomes less uniform and weaker in the center of the nip between the ends of the transfix roller and the image receiving member. As shown in FIG. 6, a nip formed with an image receiving member having a 9 mm thick wall has one pressure profile from one end to the other end of the nip across the width of the transfix roller and image receiving member, while a nip formed with an image receiving member having a 4.5 mm thick wall has another profile. The pressure profile for the thin wall member has a pressure at each end of the profile that is greater than the pressure at each end of the profile for the thick wall member. Additionally, the pressure in the center of the thin wall member profile is substantially below the pressure in the center of the thick wall member profile. These pressure differences are likely to cause wrinkles in the recording media in the nip and the print quality suffers from the lack of consistency in the pressure across the width of the nip. Enabling the nip conditions to help ensure the print quality is adequate and the media is not distorted with thinner wall image receiving members is a desirable goal.

SUMMARY

A transfix roller has been developed that forms a nip with a thinner wall image receiving member and still maintain print quality and recording media integrity. The transfix roller includes a shaft essentially comprised of a rigid material, the shaft having a first end and a second end that form a longitudinal axis for the shaft, a first portion of the shaft having a first radius extending from the longitudinal axis and the first portion being centrally positioned along the longitudinal axis of the shaft between the first and the second ends of the shaft and a remaining portion of the shaft has a radius that is less than the first radius of the shaft, and a cylindrical sleeve mounted about the shaft, the cylindrical sleeve having an inner radius that is configured to provide an interference fit about the first portion of the shaft to enable the first portion of the shaft to support a first portion of the cylindrical sleeve and to enable a second portion of the cylindrical sleeve to deform in a direction towards the remaining portion of the shaft.

An indirect printer incorporates the transfix roller to maintain print quality and media integrity with a thin wall image receiving member. The indirect printer includes an image receiving member having a rotating wall that is less than 8 mm thick, an ink applying device configured to form ink images on a surface of the image receiving member; and a transfix roller configured for movement into and out of engagement with the image receiving member to form a nip with the image receiving member for the transfer of the ink images from the image receiving member to media passing through the nip, the transfix roller further comprising a shaft essentially comprised of a rigid material, the shaft having a first end and a second end that form a longitudinal axis for the shaft, a first portion of the shaft having a first radius extending from the longitudinal axis and is centrally positioned along the longitudinal axis of the shaft between the first and the second ends of the shaft and a remaining portion of the shaft has a radius that is less than the first radius of the shaft, and a cylindrical sleeve mounted about the shaft, the cylindrical sleeve being configured to provide an interference fit about the first portion of the shaft to enable the first portion of the shaft to support a first portion of the cylindrical sleeve and to enable a second portion of the cylindrical sleeve to deform in a direction towards the remaining portion of the shaft.

BRIEF DESCRIPTION OF THE DRAWINGS

Features of the transfix roller are apparent to those skilled in the art from the following description with reference to the following drawings.

DETAILED DESCRIPTION

Figure 1:
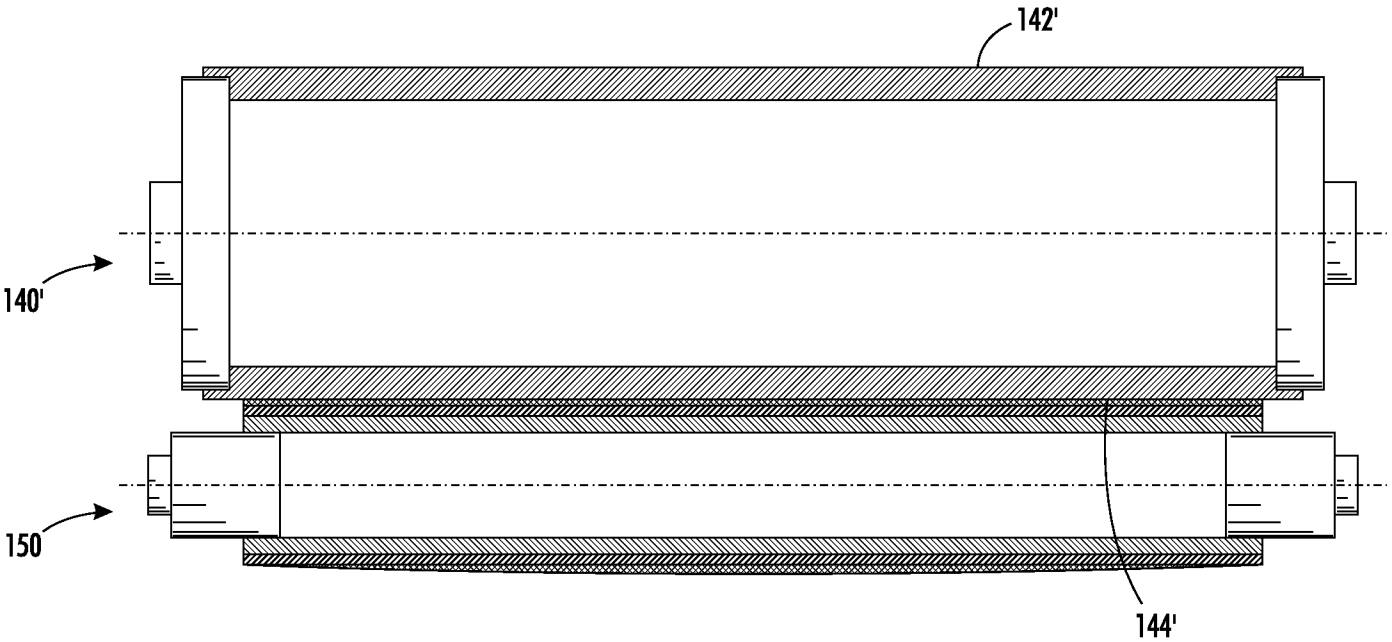
FIG. 1 is a cross sectional view of a schematic diagram of an image receiving member and a transfix roller where the image receiving member has a thinner wall than a typical image receiving member.

As noted above, FIG. 7 generally shows an indirect printer 110. This printer 110 has a typical image receiving member 140 (also referred to as a drum, an imaging drum or a print drum) and a typical transfix roller 150 which are brought together by the assembly 124 at a nip 144. Print or recording media 120 is then fed through the nip 144 between the image receiving member 140 and the transfix roller 150 to transfer the image from the image receiving member 140 to the recording media 120.

The image receiving member 140 of the prior art is a hollow cylindrical shaft that is supported on its ends by stiff endbells incorporated into the shaft. The shaft of the image receiving member 140 is formed of aluminum, or another material with similar properties, that is, for example, 9 mm thick. The shaft of the image receiving member 140 deflects under the pressure of the transfix roller 150 at the nip 144. Some deflection of the image receiving member 140 is inherent. Because the shaft of the image receiving member 140 is supported only at the endbells, it deflects more in the middle than at the ends and, thus, applies more pressure to the nip 144 at the ends than at the middle. However, too much deflection by the image receiving member 140 diminishes the quality of the print because of inconsistencies in the pressure at the nip 144. The thickness of the image receiving member 140 is selected so that it requires as little material as possible to keep manufacturing costs down. However, the thickness of the image receiving member 140 is also selected so that, under pressure from the transfix roller 150 at the nip 144, it does not deflect so much that it diminishes the quality of the print.

The transfix roller 150 of the prior art is a hollow cylindrical tube that is supported on its ends by rigid endcaps fitted into the ends of the tube. The tube of the transfix roller 150 is formed of steel, or another material with similar properties. As described above with reference to the image receiving member 140, the transfix roller 150 deflects more in the middle than at the ends because it is supported only at the ends. The variation in deflection along the length of the transfix roller 150 results in variation of the pressure along the length of the nip 144. The thickness of the transfix roller 150, like that of the image receiving member 140, is selected to balance material costs with the amount of deflection along the transfix roller 150.

Alternative embodiments of an improved transfix roller for use with a thin wall imaging drum in an indirect printer 110 are discussed below. Reference numerals, which refer to features of typical components, such as those referred to in FIG. 7, contain no added characters. Reference numerals referring to features of alternative components are denoted by a prime character.

As noted above, reducing the thickness of the wall of an image receiving member is desirable because it reduces manufacturing costs and it enables the image receiving member to be heated to an operational temperature in less time than a thicker walled member. FIG. 1 shows an indirect printer having an image receiving member with thinner walls than the image receiving member shown in FIG. 7. The walls 142' are symmetrical because they rotate to receive ink from the ink applying device 116, which is configured to form ink images on the walls 142' of the image receiving member 140', and then deposit the ink on recording media 120 passing through the nip 144'. FIG. 1 shows a cross sectional view of the contact between the image receiving member 140' having thin walls 142' and a typical transfix roller 150 at the nip 144'.

The thin walled image receiving member 140' is made of aluminum or of some other material displaying similar thermal, mechanical and hardness properties. The surface of the image receiving member 140' is one to which ink sticks temporarily upon application from a printhead and also one from which ink can be transferred to print media upon application of pressure and heat at the nip 144'. The image receiving member 140' is approximately 13.6 inches long to accommodate standard sheets of printing paper as the print media. The circumference of the image receiving member 140' should be large enough to enable efficient transfer of ink from the image receiving member 140' to the print media as the print media passes through the nip 144'. For example, if the image receiving member 140' has a circumference of 19.9 inches, the image receiving member 140' can make one full rotation per printed page for a 8" by 17" sheet of printing paper or two 8.5" by 11" sheets of paper. The image receiving member 140' in FIG. 1 has a circumference of 19.9 inches and has a diameter of about 6.33 inches. In other embodiments of the image receiving member described herein, the member has other commonly known circumferences and diameters.

Figure 7:
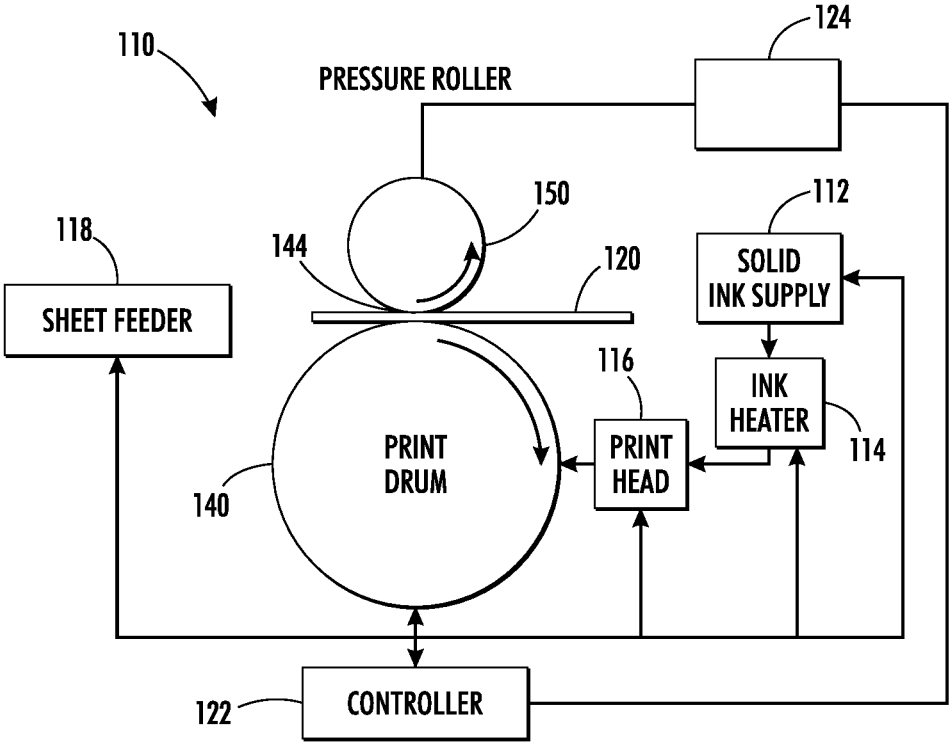
FIG. 7 PRIOR ART
FIG. 7 is a general schematic diagram of a printer including an image receiving member and a transfix roller.

The walls 142' of the image receiving member 140' must be thick enough to retain their shape despite pressure distributed over, for example, a length of 13.6 inches and a circumference of 19.9 inches. The thickness of the walls 142 of the image receiving member 140 of FIG. 7 is approximately 9 mm. As used in this document, a "thick wall" for an imaging member refers to an imaging member having a wall thickness of 9 mm or greater. The thickness of the walls 142' of the image receiving member 140' of FIG. 1 may be, for example, half the thickness of the walls 142 shown in FIG. 7 or 4.5 mm. As used in this document, a "thin wall" for an imaging member" has a thickness of 6 mm or less.

As noted above, FIG. 6 shows pressure profiles for the nip 144 shown in FIG. 7 compared to a pressure profile for the nip 144' of an image receiving member 140' having thin walls 142' as shown in FIG. 1. The ends of the nip 144 correspond to the ends of the image receiving member 140 and the transfix roller 150. Similarly, the ends of the nip 144' correspond to the ends of the image receiving member 140 and the transfix roller 150. The pressure is highest at the ends of the nips 144, 144' because the image receiving members 140, 140' and the transfix rollers 150 are supported at the ends and are the most rigid at those areas. The pressure is lowest at the middle of the nips 144, 144' because the image receiving members 140, 140' and the transfix rollers 150 deflect the most at the middle, the area that is the farthest from the supported ends.

The pressure profiles of the nips 144, 144' are impacted by a number of factors. For example, the amount of deflection of the image receiving members 140, 140' and the transfix rollers 150 is dependent upon the materials from which they are made, their thicknesses and their lengths. Additionally, the pressures at the ends of the components are dependent upon the ways in which they are connected to the printer structure. Materials having greater mechanical strength deflect less, and materials having less mechanical strength deflect more. Thicker components deflect less, and thinner components deflect more. Shorter components deflect less, and longer components deflect more. Rigid end supports create higher relative pressures at the ends of the components when the component deflects in the middle.

The pressure profile for the nip 144 has a maximum pressure of about 9.5 MPa on either end of the nip 144 and a minimum pressure of about 6.5 MPa in the middle of the nip 144. The pressure profile for the nip 144' has a maximum pressure of about 13 MPa on either end of the nip 144' and a minimum pressure of about 5 MPa in the middle of the nip 144'. Because the components in both nips 144, 144' did not differ in material, length or the way in which they were connected to the printer, none of these features accounts for the differences in the pressure profiles. The only feature of the components of the nips 144, 144' that differs is the thickness of the wall of the image receiving members 140, 140'. Because it is thinner, the thin walled image receiving member 140' deflects more at the center than image receiving member 140. Because the thin walled image receiving member 140' deflects more at the center, the pressure is lower at the center of the nip 144' than that at the center of the nip 144. Additionally, because the thin walled image receiving member 140' deflects more at the center, more stress is placed on the ends of the thin walled image receiving member 140', causing the pressure to be higher at the ends of the nip 144' than at the ends of the nip 144.

Overall, the thin wall image receiving member 140' deflects substantially more than image receiving member 140, resulting in substantial variation of pressure along the nip 144' relative to the nip 144. The variation of pressure along the nip 144' is undesirable as it may cause poor ink spread in the low pressure region in the center of the nip 144', differential gloss across the print, wrinkled prints and other print quality failures. To compensate for the substantial variation in pressure across the nip 144' formed with the image receiving member 140' having thin walls 142', a centrally supported transfix roller 150' has been developed.

Figure 2:
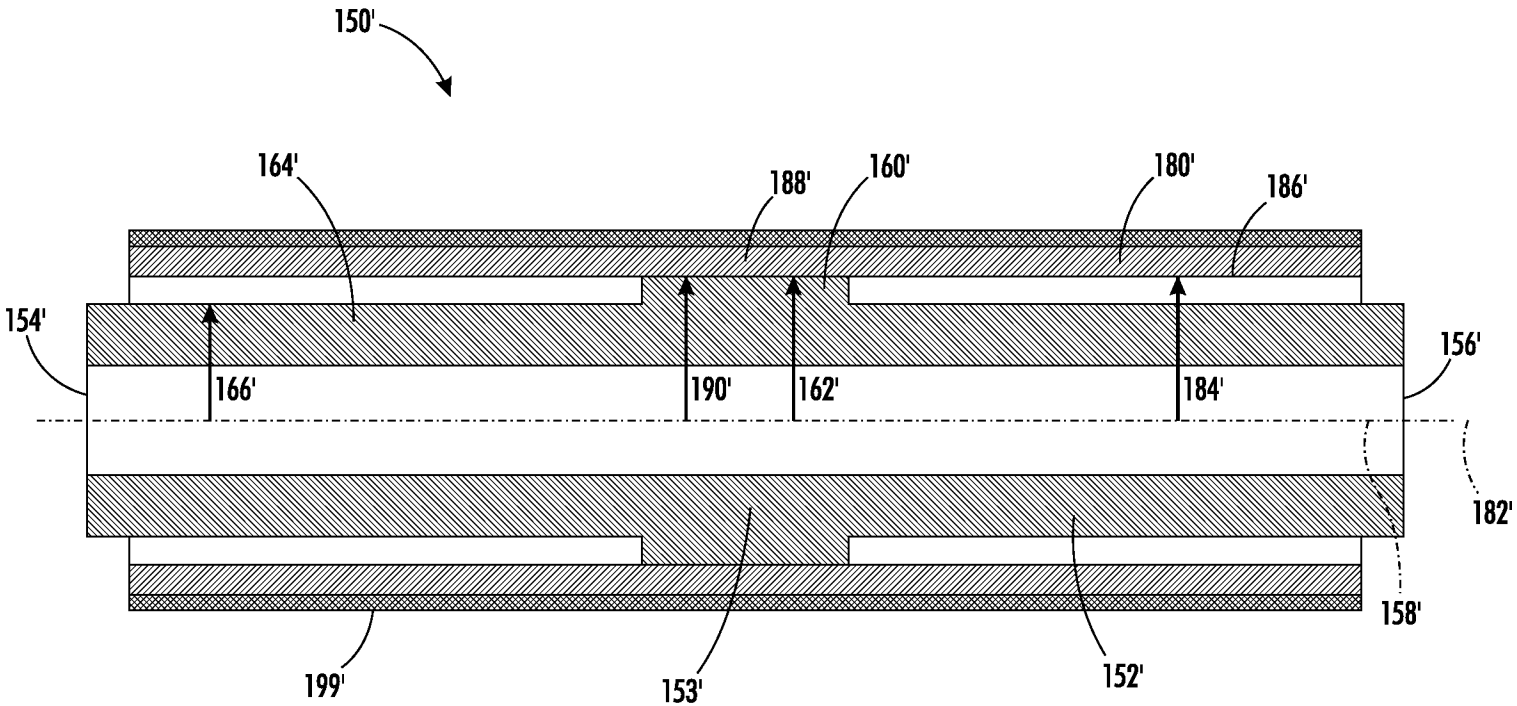
FIG. 2 is a cross sectional view of a schematic diagram of a transfix roller having central support.
Figure 6:
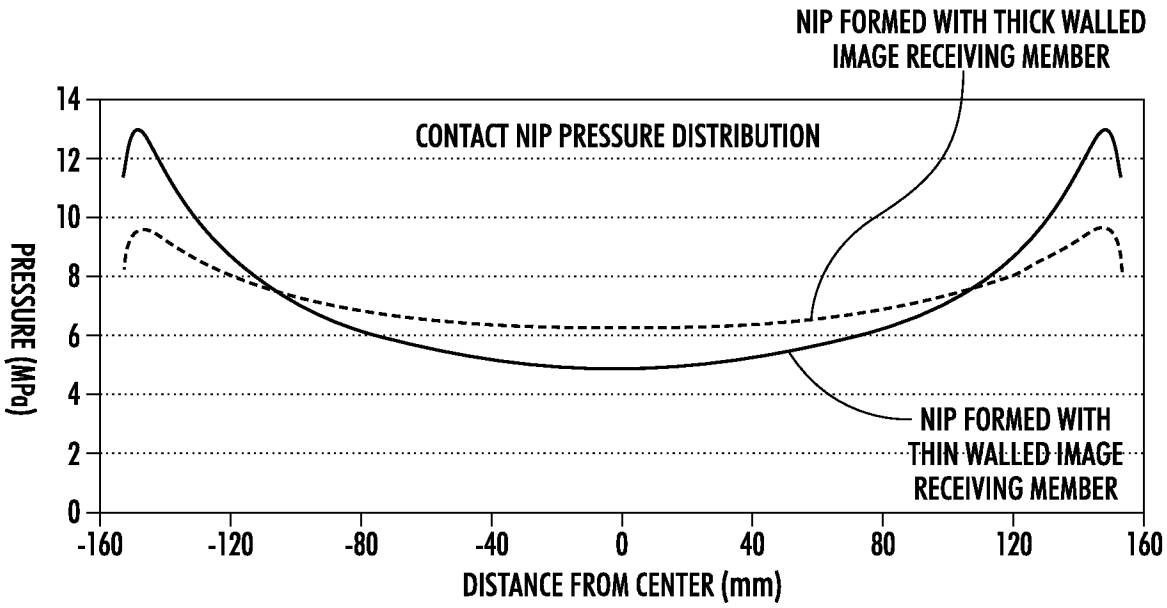
FIG. 6 is a graph of a pressure profile for a nip formed between a typical thick walled image receiving member and a transfix roller and of a pressure profile for a nip formed between a thin walled image receiving member and the same transfix roller.

FIG. 2 shows one embodiment of the centrally supported transfix roller 150' having a central support that compensates for the deflection at the center of the image receiving member 140' and the pressure variation along the nip 144' shown in FIG. 6. The transfix roller 150' is configured to be moved into and out of engagement with the image receiving member 140' to form the nip 144' for the transfer of the ink images from the image receiving member 140' to the media 120 passing through the nip 144'. The transfix roller 150' includes a shaft 152' and a cylindrical sleeve 180'.

The transfix roller 150' is approximately 13.6 inches long to apply pressure evenly along the width of standard sheets of printing paper as the print media. The circumference of the transfix roller 150' does not need to be as large as that of the image receiving member 140' because it is used to apply pressure to transfer ink from only a portion of the imaging drum to the print media 120. Thus, the transfix roller 150' may have a circumference of less than 19.9 inches and rotate at a higher frequency than the image receiving member.

The shaft 152' of the transfix roller 150' has a first end 154' and a second end 156' that form a shaft longitudinal axis 158'. The shaft 152' comprises a hollow core having a shaft wall 153' made from steel or some similar material providing appropriate thermal, mechanical and hardness properties. The shaft includes a first shaft portion 160' that extends outwardly from the shaft wall 153'. The shaft 152' has a diameter of 50 mm and the shaft wall 153' has a thickness of 7.5 mm. The first shaft portion 160' extends 4 mm outwardly from the shaft wall 153' and extends 40 mm along the longitudinal axis 158'. Thus, the total diameter for the shaft 152' at the first shaft portion 160' is 58 mm. The shaft 152' may be made of other materials or have other dimensions, but the shaft 152' needs to retain its shape despite applications of heat and pressure during use because the shape of the shaft 152' provides the central support to the transfix roller 150' allowing the transfix roller 150' to compensate for the thin walled image receiving member 140' and provide a relatively uniform pressure along the nip 144'. In another embodiment, the first portion of the shaft is divided into a plurality of portions having the radius of the first portion 160' that are separated by portions having a radius that is less than the radius of the first portion. The radius of these separating portions may be at the radius of the shaft wall 153' or at a radius between the shaft wall and the radius of the first portion. Additionally, in one embodiment, these portions are distributed symmetrically about the center of the shaft between the first end and the second end so they are centrally positioned as described below.

The cylindrical sleeve 180' of the transfix roller 150' has an inner wall 186' configured to enable the cylindrical sleeve 180' to be mounted on the outside of the shaft 152'. In particular, the cylindrical sleeve 180' must be able to be mounted on the first shaft portion 160'. The cylindrical sleeve 180' forms a cylindrical sleeve longitudinal axis 182'. When the cylindrical sleeve 180' is mounted on the shaft 152', the cylindrical sleeve longitudinal axis 182' coincides with the shaft longitudinal axis 158'.

The cylindrical sleeve 180' may be made of steel or like material with thermal, mechanical and hardness properties similar to steel. The cylindrical sleeve 180' has a diameter of 63.2 mm and a thickness of 2.6 mm. Thus, the inner wall 186' of the cylindrical sleeve 180' is 58 mm, equivalent to the total diameter for the shaft 152' at the first shaft portion 160'. Because the inner wall 186' of the cylindrical sleeve 180' is the same as the total diameter of the shaft 152', the cylindrical sleeve 180' forms an interference fit with the outside of the shaft 152', assuming a tolerance of micrometers. An interference fit is a fastening between two parts achieved only by friction between the two parts and does not require any additional means of fastening. An interference fit is generally formed by sizing the two parts such that they differ by a nominal amount where they will mate. Thus, the cylindrical sleeve 180' is securely fastened to the shaft 152' by the interference fit.

The cylindrical sleeve 180' may be made of other materials or have other dimensions, but the cylindrical sleeve 180' needs to be able to be mounted on the outside of the shaft 152'. The cylindrical sleeve 180', which is the outermost metal structure of the transfix roller 150', needs to be compliant with the image receiving member 140' to facilitate a uniform pressure applied along the nip 144', but also able to maintain sufficient rigidity to distribute the support of the shaft 152' along the length of the transfix roller 150' and along the nip 144'.

The cylindrical sleeve 180' includes an elastomeric layer 199' for contacting the print media at the nip 144'. The elastomeric layer 199' is more conformable than the steel surface of the cylindrical sleeve 180' and thus achieves improved conformability with the image receiving member 140' at the nip 144'. The elastomeric layer 199' may be made of urethane or any other material that displays similar properties of resilience and elasticity such that the transfix roller 150' applies uniform pressure along the length of the nip 144'.

The first shaft portion 160' extends outwardly from the shaft wall 153' providing central support for the transfix roller 150'. As mentioned above, the first shaft portion 160' is centrally positioned and extends 40 mm along the shaft longitudinal axis 158' between the first end 154' and the second end 156'. Alternatively, the first shaft portion 160' is centrally positioned and extends along 3-15% of the length of the shaft along longitudinal axis 158'. "Centrally positioned" for the first portion in this document means that for an equal distance on each side of the center of the shaft length between the first and second ends is occupied by the first portion. The first shaft portion 160' has a first shaft radius 162' extending from the shaft longitudinal axis 158'. The shaft 152' also includes a second shaft portion 164' consisting of the remaining portion of the shaft 152' other than the first shaft portion 160'. The second shaft portion 164' has a second shaft radius 166' extending from the shaft longitudinal axis 158'. The second shaft radius 166' is less than the first shaft radius 162'.

The cylindrical sleeve 180' includes an inner radius 184' that extends from the cylindrical sleeve longitudinal axis 182' to the inner wall 186' of the cylindrical sleeve. The inner radius 184' is chosen relative to the first shaft radius 162' so that, as mentioned above, the cylindrical sleeve 180' can be mounted on the shaft 152' with an interference fit. As used in this document, "interference fit" refers to a fastening between two parts that is achieved by friction after the parts are pushed together. That is, the mating of the two parts elastically deforms each part slightly to provide an interface between the two parts that has extremely high friction. The interference fit can be one of a transition locational fit, an interference locational fit, a press fit, or a shrink fit as defined by ANSI B4.1-1967, which is published by the American National Standards Institute. The relative sizes of the radii of the cylindrical sleeve 180' and the shaft 152' allow the inner radius 184' to fit tightly over the first shaft radius 162' with no clearance such that there is an interference fit between the two. Thus, the interference fit between the inner radius 184' and the first shaft radius 162' securely fastens the cylindrical sleeve 180' to the shaft 152', preventing the cylindrical sleeve 180' from "walking" toward one end or the other of the transfix roller 150' despite the rotation of the transfix roller 150' under the load which is applied to generate the required nip pressures for good print quality.

More specifically, the cylindrical sleeve 180' includes a first cylindrical sleeve portion 188' having a first cylindrical sleeve radius 190' extending from the cylindrical sleeve longitudinal axis 182' to the inner wall 186' of the cylindrical sleeve 180' at that portion. The first cylindrical sleeve portion 188' is configured to align with the first shaft portion 160' when the cylindrical sleeve 180' is mounted onto the shaft 152'.

The first cylindrical sleeve radius 190' is configured to fit tightly over the first shaft radius 162' with no clearance such that an interference fit occurs between the first cylindrical sleeve portion 188' and the first shaft portion 160'. The interference fit prevents the cylindrical sleeve 180' from sliding relative to the shaft 152' when pressure is applied at the nip 144'. Furthermore, the first shaft portion 160' provides support to the first cylindrical sleeve portion 188' and, thus, acts as the central support for the transfix roller 150'.

The first cylindrical sleeve portion 188' of the cylindrical sleeve 180' is supported by the first shaft portion 160', but the remainder of the cylindrical sleeve 180' is not supported by the first shaft portion 160' or the second shaft portion 164'. Therefore, the remainder of the cylindrical sleeve 180' deforms toward the second shaft portion 164' when the transfix roller 150' is pressed against the image receiving device 140' at the nip 144'. The pressure applied to the nip 144' by the transfix roller 150' is greater at the center of the nip 144' than at the ends because the first cylindrical sleeve portion 188' applies pressure resulting from the first shaft portion 160' and the pressure dissipates as it is distributed along the length of the remainder of the cylindrical sleeve 180'.

The centrally supported transfix roller 150' applies more pressure at the center of the nip 144' while the image receiving member 140' applies more pressure at the ends of the nip 144'. The pressure profile of FIG. 3 for the indirect printer having a nip formed with the thin walled image receiving member 140' and the centrally supported transfix roller 150' shows the counterbalancing pressures applied by the transfix roller 150' and the image receiving member 140' resulting in a "w" shape. The pressure profile reaches high points of about 9 MPa on each of the ends of the nip 144', reflecting the connection of the image receiving member 140' to the printer and the pressure applied there due to deflection in the components. The pressure profile is also high, about 8 MPa, at the center of the nip 144', reflecting the pressure applied by the central support in the transfix roller 150'. Between these high pressure areas, the profile drops to a low of about 7 MPa, reflecting the deflection in the image receiving member 140' between its two fixed ends and the deflection of the cylindrical sleeve 180' of the transfix roller 150' where it is not directly supported by the first shaft portion 160'.

Figure 3:
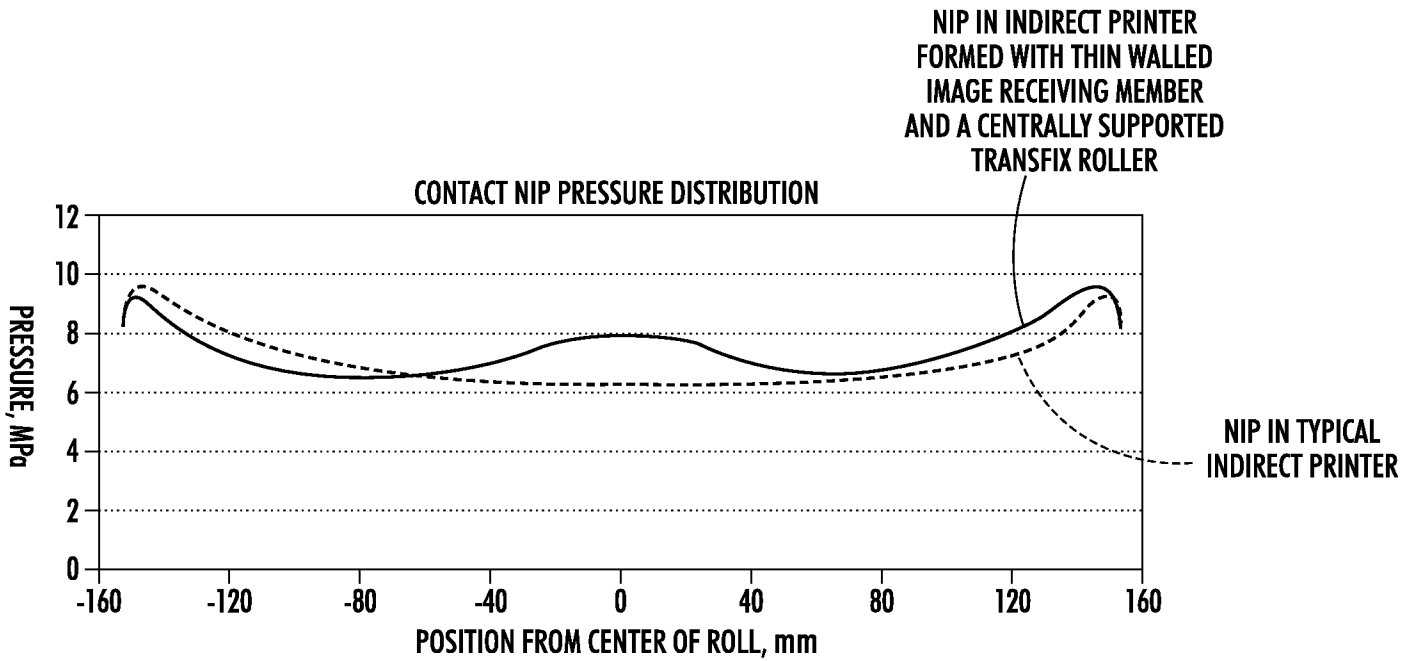
FIG. 3 is a graph of a pressure profile for a nip formed between a typical thick walled image receiving member and a typical transfix roller and of a pressure profile for a nip formed between a thin walled image receiving member and a transfix roller with central support like that shown in FIG. 2.

FIG. 3 compares the pressure profiles both for a typical nip 144 and for the nip 144' formed with an image receiving member 140' having thin walls 142' and a centrally supported transfix roller 150'. Comparing the pressure profiles shown in FIG. 6 with those shown in FIG. 3 demonstrates the benefits of the central support in the transfix roller 150' discussed above. The pressure profile for the typical indirect printer in FIG. 6 and FIG. 3 reaches high points at around 9.5 MPa at each of the ends of the nip and drops to about 6.5 MPa at the center of the nip. The pressure profile for the indirect printer having a nip formed with the thin walled image receiving member and the centrally supported transfix roller shown in FIG. 3 reaches high points of about 9 MPa on each of the ends of the nip and drops to low points of about 7 MPa before rising again to about 8 MPa at the center of the nip. The relatively consistent application of pressure along the nip 144' between the image receiving member 140' and the transfix roller 150' prevents poor ink spread, differential gloss application, wrinkling and other print quality failures.

In an alternative embodiment, the first shaft portion 160' is provided in the form of two first shaft portions 160' positioned separately along the transfix roller 150'. The total length of the two first shaft portions 160' extends along 3-15% of the length of the shaft along the longitudinal axis between the first end 154' and the second end 156'. The two first shaft portions 160' are separated by the second shaft portion 164' positioned between the two first shaft portions 160' and extending along 3-15% of the length of the shaft. This embodiment achieves relatively consistent application of pressure along the nip 144' between the image receiving member 140' and the transfix roller 150' as described above.

Although an indirect printer having a thin walled image receiving member heats up faster than an indirect printer having a typical image receiving member, allowing for less wait time by indirect printer users, the pressure applied along the nip by the thin walled image receiving member is substantially varied and may result in poor print quality. Combining a thin walled image receiving member with a centrally supported transfix roller compensates for the variations in pressure along the nip enabling generally uniform pressure at the nip. Thus, an indirect printer having both a thin walled image receiving member and a centrally supported transfix roller heats up faster than an indirect printer having a typical image receiving member, allowing for less wait time by users, and also enables relatively consistent pressure to be applied along the length of the nip, resulting in good print quality.

In order to assure good print quality in indirect printers, high loads of consistent pressure must be applied to the transfix roller to generate the required nip pressure, which may be in a range of 0.07 MPa to 34.5 MPa. In some embodiments the nip pressure is in a range of 0.7 MPa to 14 MPa and other embodiments the nip pressure is in a range of 2 MPa to 8 MPa. In order to maintain the relationship between the shaft 152' and the cylindrical sleeve 180' and prevent slippage or "walking" over the course of repeatedly applied pressure, the cylindrical sleeve 180' is securely fastened to the shaft 152'. Fastening the cylindrical sleeve 180' to the shaft 152' may be accomplished in a variety of ways. A limited number of embodiments are discussed below; however, any method which tightly fastens the cylindrical sleeve 180' to the shaft 152' and prevents slipping between the two components, or distortion of either one, is contemplated.

FIGS. 4*a*-4*c* and 5*a*-5*b* show four different ways of assembling the transfix roller 150' by affixing the cylindrical sleeve 180' to the shaft 152'. In each of the embodiments shown in FIGS. 4*a*-4*c* and 5*a*-5*b* the shaft 152' is inserted into the cylindrical sleeve 180' and is pressed from one end to overcome the friction between the outer surface of the shaft 152' and the inner surface of the cylindrical sleeve 180'. Although some friction provides interference between the shaft 152' and the cylindrical sleeve 180', which helps to ensure that they are tightly fitted together and do not slide relative to one another, too much friction in the fit increases the force required to press the shaft 152' through the cylindrical sleeve 180'. Applying too much force to insert the shaft 152' into the cylindrical sleeve 180' may result in deformation and irregularity in the parts during assembly.

Figure 4A:
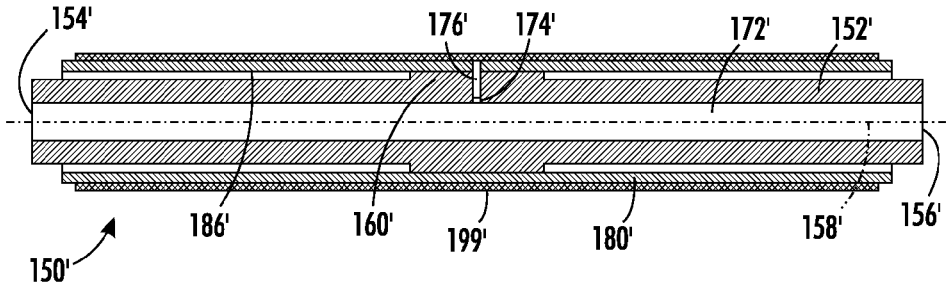
FIGS. 4*a*-4*c* are cross sectional views of schematic diagrams of alternative embodiments for a transfix roller with central support like that shown in FIG. 2.

FIG. 4*a* shows an embodiment in which the cylindrical sleeve 180' is pinned to the shaft 152'. In this embodiment, the shaft 152' includes a first passageway 172' that is centered about the shaft longitudinal axis 158' and extends from the first end 154' to the second end 156' of the shaft 152'. The cylindrical sleeve 180' includes a second passageway 174' that is perpendicular to the first passageway 172'. The second passageway 174' extends through the cylindrical sleeve 180' and terminates in the first shaft portion 160'. The shaft 152' is pressed into the cylindrical sleeve 180' against the friction between the first shaft portion 160' and the inner wall 186' of the cylindrical sleeve 180'. Once the shaft 152' is properly positioned within the cylindrical sleeve 180', a member 176' is configured to be received within the second passageway 174' to secure the cylindrical sleeve 180' to the first shaft portion 160'. The member 176' is sized such that it fits tightly within the second passageway 174' with no clearance and produces an interference fit between the member 176' and the second passageway 174'. In this way the cylindrical sleeve 180' is "pinned" to the shaft 152'. The member 176' is made of any material having any thickness which fits tightly in the second passageway 174' and prevents the member 176' from shearing or breaking between the cylindrical sleeve 180' and the shaft 152'. The member 176' may be in the form of a pin or, alternatively, may be in any other form that can be received in the second passageway 174' that secures the cylindrical sleeve 180' to the first shaft portion 160' as described above. In this embodiment, the elastomeric layer 199' may be applied to the transfix roller 150' after the shaft 152' and the cylindrical sleeve 180' have been assembled.

Figure 4B:
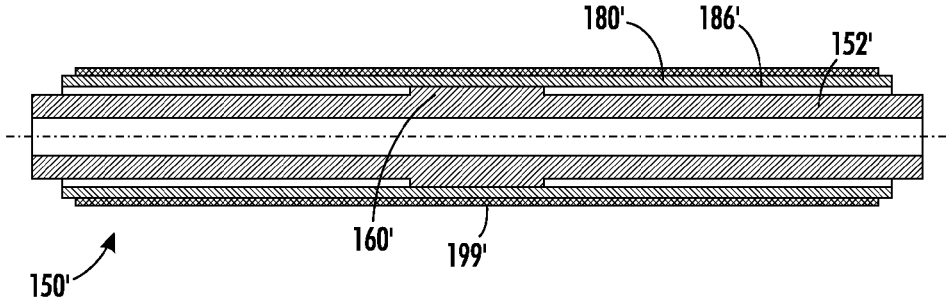

FIG. 4*b* shows an embodiment in which the cylindrical sleeve 180' is welded to the shaft 152'. In this embodiment, the shaft 152' is pressed into the cylindrical sleeve 180' against the friction between the first shaft portion 160' and the inner wall 186' of the cylindrical sleeve 180'. Once the shaft 152' is properly positioned within the cylindrical sleeve 180', the two surfaces can be spot welded or friction welded together at the first shaft portion 160' and the first cylindrical sleeve portion 188'. A spot weld is the joining of contacting metal surfaces by the application of heat obtained from resistance to electric current flow. It is applied over a small spot rather than over a larger area of the two metal surfaces to be welded together. A friction weld is the joining of contacting metal surfaces by the application of heat generated through mechanical friction between a moving component and a stationary component. A lateral force is applied to the moving component to plastically displace and fuse the materials. In this embodiment, the elastomeric layer 199' may be applied to the transfix roller 150' after the shaft 152' and the cylindrical sleeve 180' have been assembled.

Figure 4C:
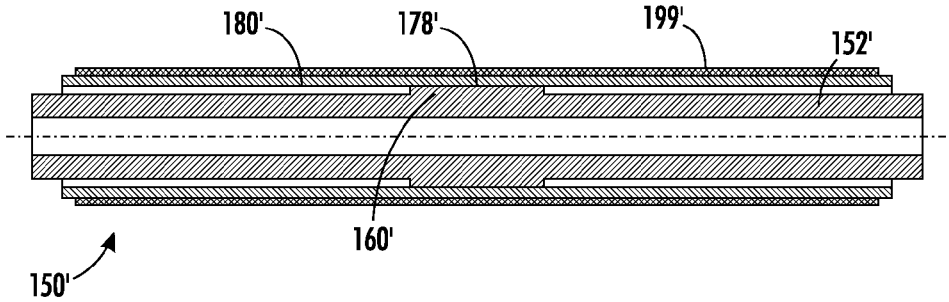

FIG. 4*c* shows an embodiment in which the shaft 152' has a knurled surface 178' on the circumference of the first shaft portion 160'. The knurled surface 178' increases the friction between the shaft 152' and the cylindrical sleeve 180' that increases the interference as the shaft 152' is pressed into the cylindrical sleeve 180' to assemble the transfix roller 150'. This increased interference requires higher pressing forces to be applied during assembly, but no additional fastening of the cylindrical sleeve 180' to the shaft 152' is required. In this embodiment, the elastomeric layer 199' may be applied to the transfix roller 150' before or after the shaft 152' and the cylindrical sleeve 180' have been assembled.

Figure 5A:
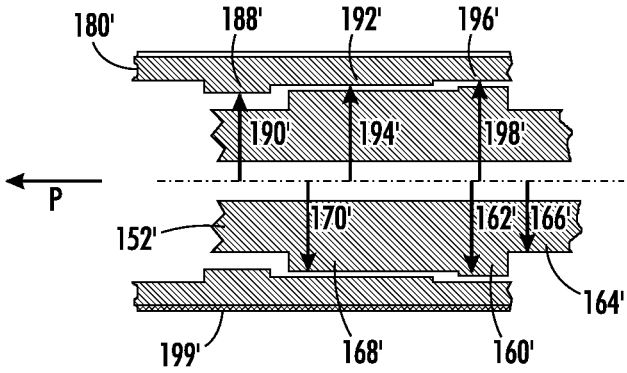
FIGS. 5*a*-5*b* are partial cross sectional views of schematic diagrams of an alternative embodiment for a transfix roller with central support like that shown in FIG. 2.
Figure 5B:
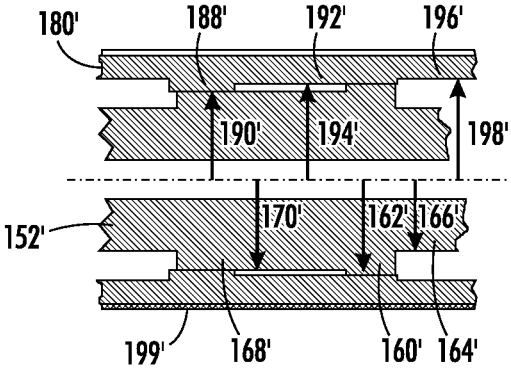

FIGS. 5*a*-5*b* show an embodiment in which the shaft 152' and the cylindrical sleeve 180' include staggered portions that provide additional friction between the two parts when the two parts are pushed together in a mating relationship. The shaft 152' of this embodiment includes a third shaft portion 168' having a third shaft radius 170' extending from the shaft longitudinal axis 158'. The third shaft radius 170' is greater than the second shaft radius 166' but is less than the first shaft radius 162'. The cylindrical sleeve 180' includes a second cylindrical sleeve portion 192' having a second cylindrical sleeve radius 194' and a third cylindrical sleeve portion 196' having a third cylindrical sleeve radius 198' extending from the cylindrical sleeve longitudinal axis 182'. The third cylindrical sleeve radius 198' is greater than the second cylindrical sleeve radius 194' which is greater than the first cylindrical sleeve radius 190'. The relative sizes of the radii of the shaft 152' and the cylindrical sleeve 180' are configured such that when the shaft 152' is pressed in the direction of the arrow P (shown in FIG. 5*a*) relative to the cylindrical sleeve 180', the shaft 152' and the cylindrical sleeve 180' engage where the first shaft portion 160' contacts the second cylindrical sleeve portion 192' and where the third shaft portion 168' contacts the first cylindrical sleeve portion 188' (shown in FIG. 5*b*). Thus, the first shaft portion 160' does not engage with the third cylindrical sleeve portion 196' as shown in FIG. 5*a*, but the first shaft portion 160' does engage with the second cylindrical sleeve portion 192' as shown in FIG. 5*b*. Additionally, the third shaft portion 168' does not engage with the second cylindrical sleeve portion 192' as shown in FIG. 5*a*, but the third shaft portion 168' does engage with the first cylindrical sleeve portion 188'. In this embodiment, the elastomeric layer 199' may be applied before or after the shaft 152' and the cylindrical sleeve 180' have been assembled.

The embodiment shown in FIGS. 5*a*-5*b* is advantageous because it increases the amount of friction between the shaft 152' and the cylindrical sleeve 180', but it does so only along a limited length of the transfix roller 150'. Pressing the parts together with more interference area requires high forces, generates heat, and possibly distorts the transfix roller 150' or the cylindrical tube 180'. However, because the third shaft portion 168' only overlaps with the first cylindrical sleeve portion 188' and the first shaft portion 160' only overlaps with the second cylindrical sleeve portion 192' for a central portion of the transfix roller 150', the length of the press is significantly reduced. This embodiment, like the knurled surface embodiment described above and shown in FIG. 4*c*, does not require additional fastening between the shaft 152' and the cylindrical sleeve 180'.

In use, a thin walled image receiving member 140' and a centrally supported transfix roller 150' are inserted into an indirect printer. The heating time for the indirect printer is relatively short compared to that of an indirect printer having a typical thick wall image receiving member 140. Once the printer commences printing operations, the thin walled image receiving member 140' and the centrally supported transfix roller 150' contact one another at the nip 144'. Along the length of the nip 144', the transfix roller 150' is the stiffest in the center (due to the first shaft portion 160') where the image receiving member 140' is the softest and the transfix roller 150' is the softest near the ends where the image receiving member 140' is the stiffest (due to the connections to the printer). Thus, the pressure profile along the length of the nip 144' of FIG. 3 remains relatively uniform and ensures an appropriate range of pressures that provide good quality images.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A transfix roller for use in an indirect printer having a thin wall image receiving member comprising:

a shaft essentially comprised of a rigid material, the shaft having a first end and a second end that form a longitudinal axis for the shaft, a first portion of the shaft having a first radius extending from the longitudinal axis and the first portion being centrally positioned along the longitudinal axis of the shaft between the first and the second ends of the shaft and a remaining portion of the shaft has a radius that is less than the first radius of the shaft, the first radius extends perpendicularly from the longitudinal axis of the shaft to form a cylindrical first portion of the shaft having a first length that is less than a length of the shaft between the first and the second ends of the shaft, and the radius of the remaining portion extends perpendicularly from the longitudinal axis of the shaft to form a cylindrical first remaining portion between the cylindrical first portion and the first end of the shaft having a second length and to form a cylindrical second remaining portion between the first portion and the second end of the shaft having a third length, a sum of the second length and the third length being greater than the first length of the cylindrical first portion of the shaft; and a cylindrical sleeve mounted about the shaft, the cylindrical sleeve having an inner radius that is configured to provide an interference fit about the first portion of the shaft to enable the first portion of the shaft to support a first portion of the cylindrical sleeve and to enable a second portion of the cylindrical sleeve to deform in a direction towards the remaining portion of the shaft.

2. The transfix roller of claim 1, the first portion of the shaft further comprising:

a knurled surface along a circumference of the cylindrical first portion of the shaft, and the cylindrical first remaining portion and the cylindrical second remaining portion have a smooth surface.

3. The transfix roller of claim 1, the shaft further comprising:

a first cylindrical passageway that passes through the cylindrical first remaining portion, the cylindrical first portion, and the cylindrical second remaining portion, the first cylindrical passageway being centered about the longitudinal axis of the shaft that extends from the first end of the shaft to the second end of the shaft.

4. The transfix roller of claim 3 further comprising:

another passageway perpendicular to the first passageway of the shaft, the other passageway extending through the cylindrical sleeve and terminating at the first cylindrical passageway passing through the cylindrical first portion of the shaft; and a member received within the other passageway to secure the cylindrical sleeve to the cylindrical first portion of the shaft, the member received within the other passageway terminating at the first cylindrical passageway passing through the cylindrical first portion of the shaft.

5. The transfix roller of claim 1 further comprising:

a spot weld between the cylindrical sleeve and the cylindrical first portion of the shaft.

6. The transfix roller of claim 1 further comprising:

a friction weld between the cylindrical sleeve and the cylindrical first portion of the shaft.

7. The transfix roller of claim 1 the cylindrical sleeve further comprising:

an inner wall having a first cylindrical portion with a first radius from a longitudinal axis of the cylindrical sleeve, a second cylindrical portion with a second radius from the longitudinal axis of the cylindrical sleeve, and a third cylindrical portion with a third radius from the longitudinal axis of the cylindrical sleeve, the first radius being less than the second radius and the second radius being less than the third radius; and the cylindrical first portion of the shaft having a portion with a third radius that is between the first radius and the second radius from the longitudinal axis of the shaft, the portion of the cylindrical first portion of the shaft having the first radius being configured to provide an interference fit with the second cylindrical portion of the cylindrical sleeve having the second radius and the portion of the cylindrical first portion of the shaft having the third radius being configured to provide an interference fit with the first cylindrical portion of the cylindrical sleeve having the first radius.

8. The transfix roller of claim 7, wherein the length of the first cylindrical portion of the shaft is about 3 to about 15 percent of a sum of the length of the first cylindrical portion of the shaft, the second length of the first remaining portion of the shaft and the third length of the second remaining portion of the shaft.

9. The transfix roller of claim 1 further comprising:

at least one other remaining portion of the shaft having a radius that is less than the first radius of the shaft, the at least one other remaining portion separating the cylindrical first portion of the shaft into two cylindrical portions.

10. The transfix roller of claim 1 further comprising:

an elastomeric layer overlying the cylindrical sleeve.

11. An indirect imaging device comprising:

an image receiving member having a rotating wall that is less than 8 mm thick;

an ink applying device configured to form ink images on a surface of the image receiving member; and a transfix roller configured for movement into and out of engagement with the image receiving member to form a nip with the image receiving member for the transfer of the ink images from the image receiving member to media passing through the nip, the transfix roller further comprising:

a shaft essentially comprised of a rigid material, the shaft having a first end and a second end that form a longitudinal axis for the shaft, a first portion of the shaft having a first radius extending from the longitudinal axis and is centrally positioned along the longitudinal axis of the shaft between the first and the second ends of the shaft and a remaining portion of the shaft has a radius that is less than the first radius of the shaft, the first radius extends perpendicularly from the longitudinal axis of the shaft to form a cylindrical first portion of the shaft having a first length that is less than a length of the shaft between the first and the second ends of the shaft, and the radius of the remaining portion extends perpendicularly from the longitudinal axis of the shaft to form a cylindrical first remaining portion between the cylindrical first portion and the first end of the shaft having a second length and to form a cylindrical second remaining portion between the first portion and the second end of the shaft having a third length, a sum of the second length and the third length being greater than the first length of the cylindrical first portion of the shaft; and a cylindrical sleeve mounted about the shaft, the cylindrical sleeve being configured to provide an interference fit about the first portion of the shaft to enable the first portion of the shaft to support a first portion of the cylindrical sleeve and to enable a second portion of the cylindrical sleeve to deform in a direction towards the remaining portion of the shaft.

12. The indirect imaging device of claim 11, the first portion of the shaft of the transfix roller further comprising:

a knurled surface along a circumference of the cylindrical first portion of the shaft, and the cylindrical first remaining portion and the cylindrical second remaining portion have a smooth surface.

13. The indirect imaging device of claim 11, the shaft of the transfix roller further comprising:

a first cylindrical passageway that passes through the cylindrical first remaining portion, the cylindrical first portion, and the cylindrical second remaining portion, the first cylindrical passageway being centered about the longitudinal axis of the shaft that extends from the first end of the shaft to the second end of the shaft.

14. The indirect imaging device of claim 13, the transfix roller further comprising:

another passageway perpendicular to the first passageway of the shaft, the other passageway extending through the cylindrical sleeve and terminating at the first cylindrical passageway passing through the cylindrical first portion of the shaft; and a member received within the other passageway to secure the cylindrical sleeve to the first portion of the shaft, the member received within the other passageway terminating at the first cylindrical passageway passing through the cylindrical first portion of the shaft.

15. The indirect imaging device of claim 11 wherein the cylindrical sleeve of the transfix roller is secured to the cylindrical first portion of the shaft of the transfix roller with a spot weld.

16. The indirect imaging device of claim 11 wherein the cylindrical sleeve of the transfix roller is secured to the cylindrical first portion of the shaft with a friction weld.

17. The indirect imaging device of claim 11 further comprising:

an inner wall having a first cylindrical portion with a first radius from a longitudinal axis of the cylindrical sleeve, a second cylindrical portion with a second radius from the longitudinal axis of the cylindrical sleeve, and a third cylindrical portion with a third radius from the longitudinal axis of the cylindrical sleeve, the first radius being less than the second radius and the second radius being less than the third radius; and the cylindrical first portion of the shaft of the transfix roller having a portion with a third radius that is between the first radius and the second radius from the longitudinal axis of the shaft, the portion of the first cylindrical portion of the shaft having the first radius being configured to provide an interference fit with the second cylindrical portion of the cylindrical sleeve having the second radius and the portion of the cylindrical first portion of the shaft having the third radius being configured to provide an interference fit with the first cylindrical portion of the cylindrical sleeve having the first radius.

18. The indirect imaging device of claim 17, wherein the length of the first cylindrical portion of the shaft is about 3 to about 15 percent of a sum of the length of the first cylindrical portion of the shaft, the second length of the first remaining portion of the shaft and the third length of the second remaining portion of the shaft.

19. The indirect imaging device of claim 11, the transfix roller further comprising:

an elastomeric layer overlying the cylindrical sleeve.

20. The indirect imaging device of claim 11, the first portion of the shaft further comprising:

at least one other remaining portion of the shaft having a radius that is less than the first radius of the shaft, the at least one other remaining portion separating the cylindrical first portion of the shaft into two cylindrical portions.

* * * * *